US005503102A

United States Patent [19]

McDonnell

[11] Patent Number: 5,503,102

[45] Date of Patent: Apr. 2, 1996

[54] SHAPE RETAINING BOOK MARK

[76] Inventor: Jean A. McDonnell, 508 Denner St., Kalamazoo, Mich. 49006

[21] Appl. No.: 344,070

[22] Filed: Nov. 23, 1994

[51] Int. Cl.[6] ..... B42D 9/00

[52] U.S. Cl. ..... 116/238; 116/239; 281/42

[58] Field of Search ..... 116/234–239; 281/28, 30, 31, 42, 51; 428/40; 24/30.5 R, 30.5 P, 30.5 T, 304

[56] References Cited

U.S. PATENT DOCUMENTS

| | | | |
|---|---|---|---|
| 1,805,732 | 5/1931 | Dittmann . | |
| 2,371,357 | 3/1945 | Schindler . | |
| 2,591,094 | 4/1952 | O'Neill . | |
| 2,633,372 | 3/1953 | Wilson | 116/239 |
| 2,973,597 | 3/1961 | Powell . | |
| 3,011,471 | 12/1961 | Tam | 116/238 |
| 3,409,948 | 11/1968 | Goodwin | 24/30.5 T |
| 4,539,237 | 9/1985 | Clayton | 24/30.5 R |
| 4,574,727 | 3/1986 | Martin, Jr. . | |
| 4,915,996 | 4/1990 | Curry | 24/30.5 T |

FOREIGN PATENT DOCUMENTS

| | | | |
|---|---|---|---|
| 2223449 | 4/1990 | United Kingdom | 116/234 |
| 2275018 | 8/1994 | United Kingdom | 116/238 |

*Primary Examiner*—William A. Cuchlinski, Jr.
*Assistant Examiner*—Andrew Hirshfeld
*Attorney, Agent, or Firm*—Edward J. Timmer

[57] ABSTRACT

A book mark includes a laminated construction that that can be conveniently shaped; e.g. bent, by the user of the book as needed to mark a page and that will retain the shape until the book user desires to mark the next page. The book mark includes an elongated, deformable metal or other wire strand laminated or sandwiched between opposing, elongated strips of paper or plastic adhered together. The paper strips have a greater width than the wire and provide on exterior surfaces thereon that can readily printed or otherwise marked with an asethetic desgin or message for the user of the book. The book mark can include adhesive thereon proximate an end thereof for fastening the book mark to the inside of the back cover or front cover of the book. Alternately, the book mark can be used in combination with an adhesive label that is adhered to the inside of the front or back cover of the book with the mark therebetween. Still further, an end region of the book mark can be received and captured in a pocket formed in the inside of the front or back cover of the book, or in the binding of the book.

7 Claims, 4 Drawing Sheets

SHAPE RETAINING BOOK MARK

FIELD OF THE INVENTION

The present invention relates to a book mark for marking a page of a book.

BACKGROUND OF THE INVENTION

U.S. Pat. No. 1,805,732 discloses a book mark having a movable tongue for marking a page of the book. U.S. Pat. Nos. 2,591,094 and 4,574,727 describe book marks having an adhesive anchor or connector that is adhered to the front inside cover of the book and a ribbon, string or like page mark connected to the anchor or connector.

An object of the present invention is to provide a laminated book mark that is low in cost and that can be conveniently shaped; e.g. bent, by the user of the book as needed to mark a page and that will retain the shape until the book user desires to mark another page.

SUMMARY OF THE INVENTION

The present invention provides a book mark comprising a laminated construction that can be conveniently shaped; e.g. bent, by the user of the book as needed to mark a page and that will retain the shape until the book user desires to mark another page. In one embodiment of the invention, the book mark comprises an elongated, deformable metal or other wire strand laminated or sandwiched between opposing, elongated strips of paper or plastic adhered together. The strips have a greater width than that of the wire strand and provide exterior surfaces that can be printed or otherwise marked with an asethetic desgin or message for the user of the book.

The book mark can include adhesive proximate an end thereof for fastening the book mark to the inside of the back cover or front cover of the book.

Alternately, the book mark can be used in combination with an adhesive label that is adhered to the inside of the front cover or back cover of the book with the book mark therebetween. The label can include an exterior surface that can be printed or otherwise marked with an asethetic design or message for the user of the book.

Still further, an end region of the book mark can be received and captured in a pocket formed on the inside of the front cover or back cover of the book, or captured in the binding of the book.

DESCRIPTION OF THE INVENTION

Figure 1:
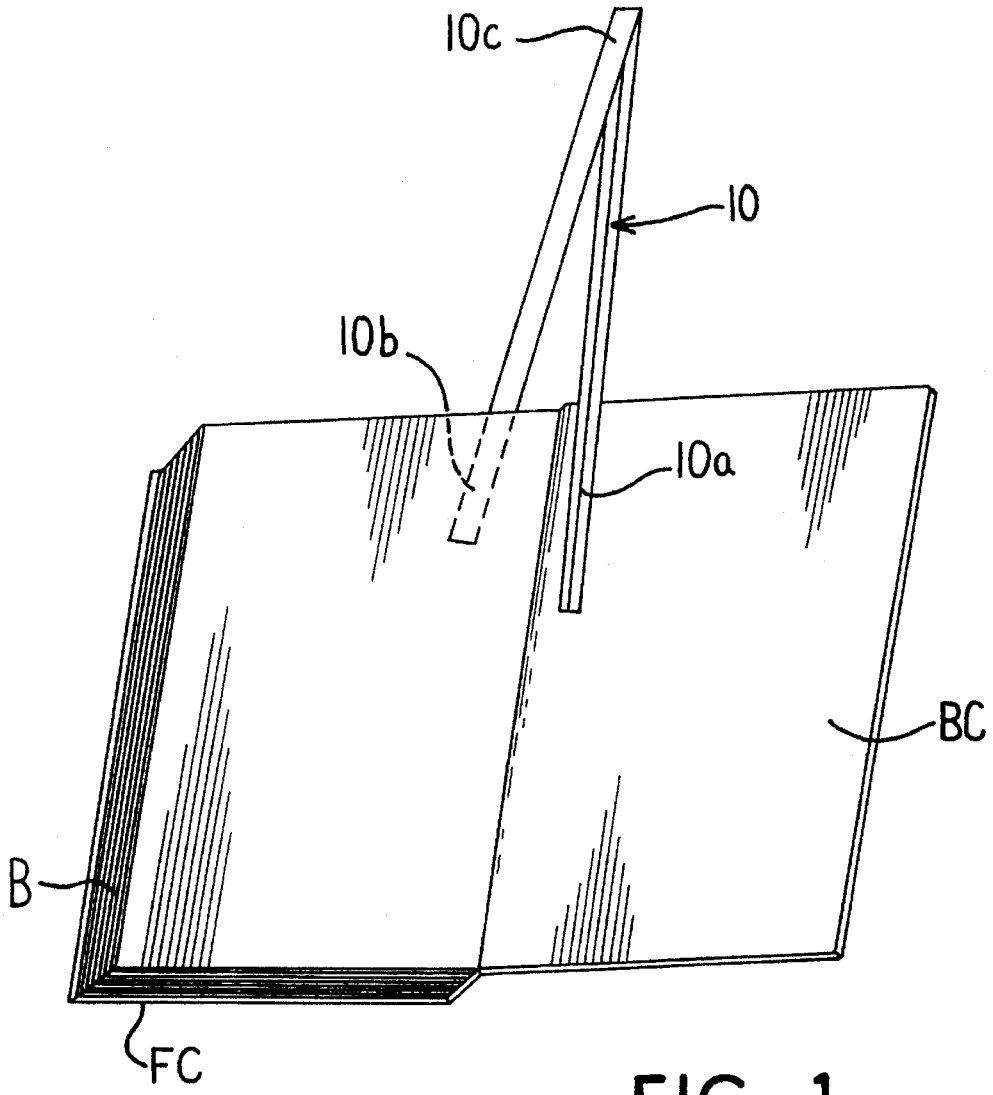
FIG. 1 is a perspective view of a book and a book mark pursuant to one embodiment of the invention.
Figure 2:
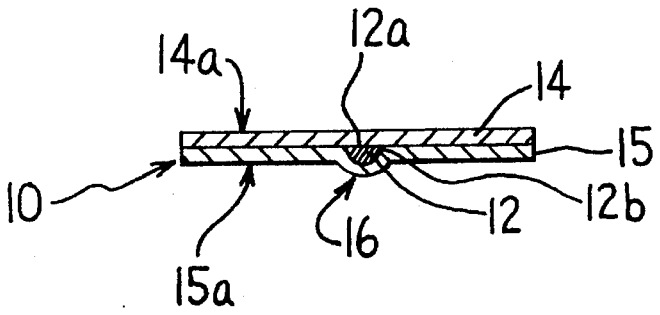
FIG. 2 is a transverse cross sectional view of the book mark showing the laminated construction.

Referrring to FIGS. 1 and 2, a book mark 10 in accordance with one embodiment of the invention comprises a laminated construction that can be conveniently shaped; e.g. bent, by the user of the book as needed to mark a page and that will retain the shape until the book user desires to mark another page. In the embodiment of the invention shown in FIGS. 1 and 2, the book mark 10 comprises an elongated, narrow, deformable metal or other wire strand 12 laminated or sandwiched between opposing, elongated strips or layers 14, 15 of paper or plastic (e.g. metallized plastic such as Mylar plastic) adhered together by pressure responsive adhesive applied to their inner facing surfaces. The wire strand 12 has a flat side **12*a* and a semi-circular side 12*b* as shown in FIG. 2. The strips 14, 15 have a width greater than the width of the wire strand 12**. For example, the width of the strips is approximately ½ inch, whereas the width or diameter of the wire is approximately 1/32 inch.

As shown, in FIG. 2, one of the strips 14 provides an exterior surface **14*a* that is flat across its full width. The flat side 12*a* of the wire 12 is adjacent this paper strip 14. The exterior surface 14*a* can be readily printed or otherwise marked with an asethetic design or message for the user of the book. The other strip 15 includes an exterior surface 15*a* having a bulge 16 along its length where the semi-circular periphery 12*b* of the wire strand protrudes between the strips 14, 15**.

The laminated book mark typically has a length generally between 8 to 16 inches, although other lengths can be used depending on the size of the book pages. The book mark can be cut to length from laminated paper strips/wire strand material available as band-tie material from Bedford Industries, Inc., 1659 Rowe Avenue, Worthington, Minn. The ends of the book mark 10 can be cut to rounded, square, or other shape if desired.

The book mark 10 can be used without or with permanent attachment to a book. For example, the book mark 10 can have one end region **10*a* simply placed between the back cover of the book B and the last page and another end region 10*b* to mark a preceding page and bent over by intermediate bent region 10*c* to this end as shown in FIG. 1. Alternately, the book mark 10 can include adhesive thereon proximate the end region 10*a* for permanently fastening the book mark 10** to the inside of the back cover BC (or front cover FC) of the book B.

Figure 3:
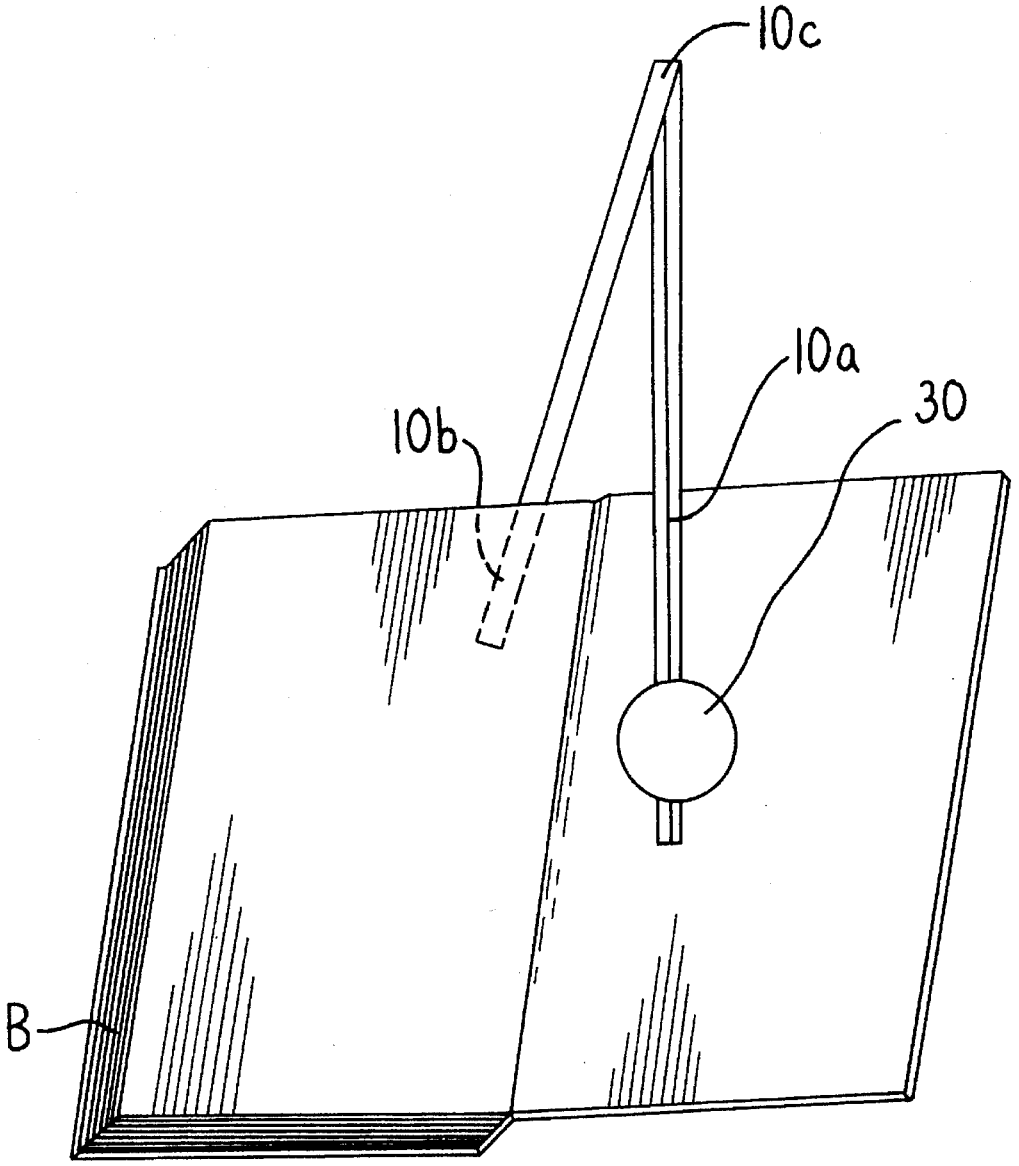
FIG. 3 is a perspective view of a book and a book mark pursuant to another embodiment of the invention.

Alternately, as shown in FIG. 3, the book mark 10 can be used in combination with a paper, plastic or other adhesive label 30 that is adhered to the inside of the back cover BC (or front cover FC) of the book B with the end region **10*a* of the book mark 10 disposed therebetween. The label 30 can be rectangular, circular, oval or other shape and and is sized to provide sufficient adhesive surface to hold the end region 10*a* to the book cover. To this end, the label 30 includes an inner surface having pressure responsive adhesive thereon for attachment to the book cover BC or FC and an exterior surface that can be printed or otherwise marked with an asethetic design or message for the user of the book. Labels having sizes of 3 inches in width by 1 to 2 inches in height can be used in practicing the invention, although other label sizes can be used. The label 30** can be located on the front or back cover at a suitable location depending on the size of the book B.

Figure 4:
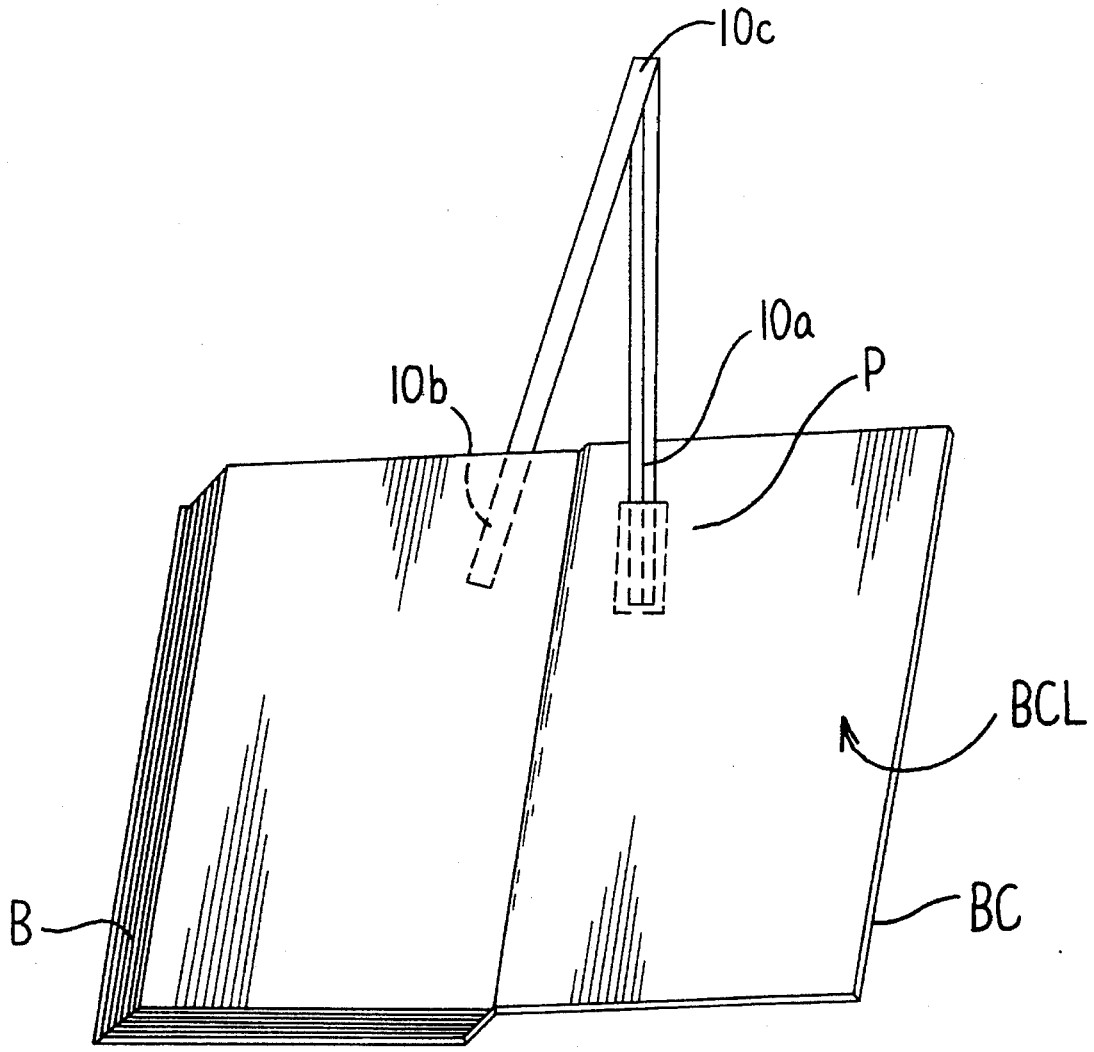
FIG. 4 is a perspective view of a book and a book mark pursuant to still another embodiment of the invention.

Still further, as shown in FIG. 4, the end region **10*a* of the book mark 10 can be received and captured in a pocket P formed on the the back cover BC (or front cover FC) of the book B. For example, the end region 10*a*** can be received and adhered in the pocket P formed between the back cover BC and a back cover paper liner BCL during the book manufacturing process.

Figure 5:
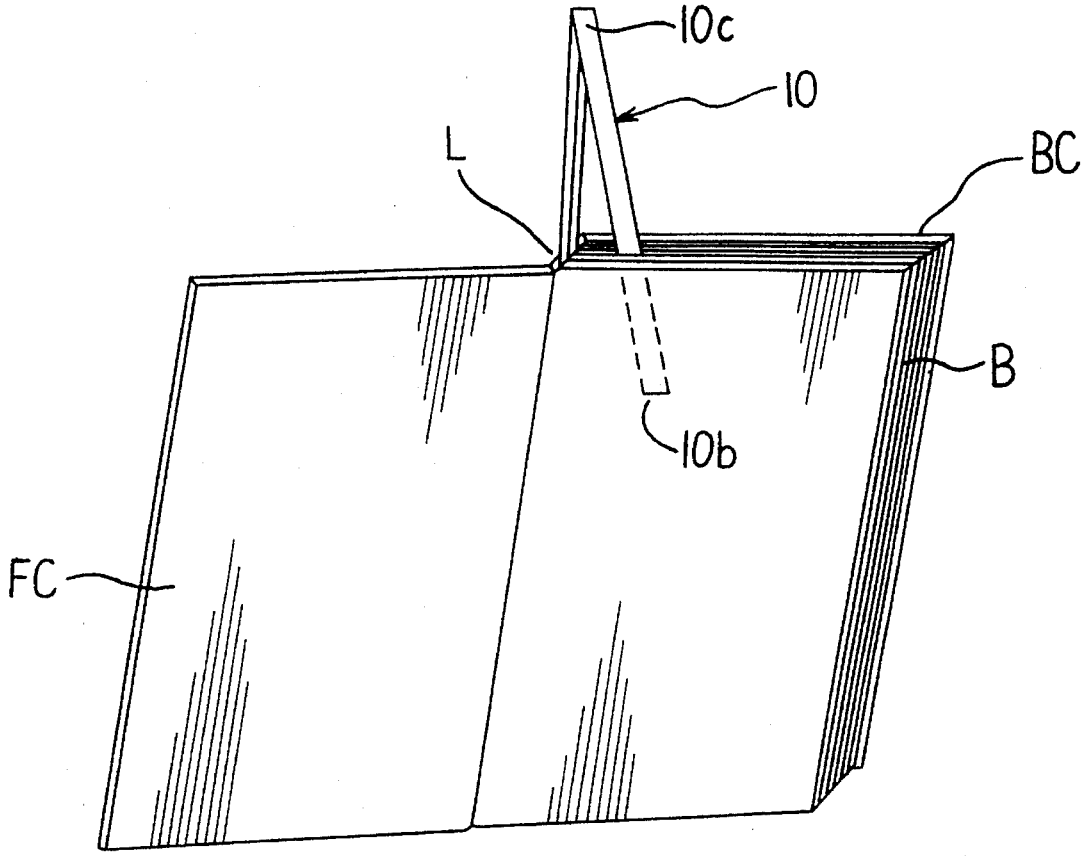
FIG. 5 is a perspective view of a book and a book mark pursuant to still another embodiment of the invention.

Or, the end region 10*a* of the book mark 10 can be received and captured in the binding L of the book B as shown in FIG. 5. For example, the end 10*a* of the book mark 10 can be adhered in or sewn in the binding L during the book manufacturing process.

Although certain embodiments of the invention have been described in detail above, those skilled in the art will appreciate that changes and modfications can be made therein within the scope of the invention as set forth in the following claims.

I claim:

1. In combination with a book having a cover, a book mark comprising an elongated, deformable wire strand laminated between opposing, elongated strips comprising a material selected from at least one of paper and plastic, said strips being adhered together and having strip widths greater than the width of said deformable wire strand, said book mark being bendable by a user of the book to mark a page with the bent shape being retained by said book mark and further comprising an adhesive label that is adhered to the cover of the book with said wire strand and elongated strips therebetween.

2. The book mark of claim 1 wherein the strips include exterior surfaces that can be readily printed with an asethetic design or message for the user of the book.

3. The book mark of claim 1 wherein the label includes an exterior surface that can be printed with an asethetic design or message for the user of the book.

4. In combination with a book having a cover, a book mark comprising an elongated book mark member captured in a pocket formed on the book cover, said book mark member comprising an elongated, deformable wire strand laminated between opposing, elongated strips comprising a material selected from at least one of paper and plastic, said strips being adhered together and having strip widths greater than the width of said deformable wire strand, said book mark member being bendable by a user of the book to mark a page with the bent shape being retained by said book mark member, said book mark member having an end region captured in said pocket.

5. In combination with a book having a binding, a book mark comprising an elongated book mark member captured in the binding of said book, said book mark member comprising an elongated, deformable wire strand laminated between opposing, elongated strips comprising a material selected from at least one of paper and plastic, said strips being adhered together and having strip widths greater than the width of said deformable wire strand, said book mark member being bendable by a user of the book to mark a page with the bent shape being retained by said book mark member, said book mark member having an end region captured in said binding.

6. In combination with a book having pages, a book mark comprising an elongated, deformable wire strand laminated between opposing, elongated strips comprising a material selected from at least one of paper and plastic, said strips being adhered together and having strip widths greater than the width of said deformable wire strand, said book mark being bendable by a user of the book to position an end region thereof between adjacent pages with the bent shape being retained by said wire strand of said book mark, said adjacent pages securing said end region in said book.

7. In combination with a book having a cover, a book mark comprising an elongated, deformable wire strand laminated between opposing, elongated strips comprising a material selected from at least one of paper and plastic, said strips being adhered together and having strip widths greater than the width of said deformable wire strand, said book mark being bendable by a user of the book to mark a page with the bent shape being retained by said book mark, said book mark further comprising adhesive on an end region of one of the elongated strips securing the elongated strips to the cover of the book.

* * * * *